US009139984B2

(12) United States Patent
Chenoweth et al.

(10) Patent No.: US 9,139,984 B2
(45) Date of Patent: Sep. 22, 2015

(54) RETAINER SYSTEMS FOR GROUND ENGAGING TOOLS

(71) Applicant: CATERPILLAR INC., Peoria, IL (US)

(72) Inventors: Scott Dale Chenoweth, Emeryville, CA (US); Garrett David Knight, Port Elgin (CA); Murray Allen Smith, Ontario (CA)

(73) Assignee: Caterpillar Inc., Peoria, IL (US)

( * ) Notice: Subject to any disclaimer, the term of this patent is extended or adjusted under 35 U.S.C. 154(b) by 97 days.

(21) Appl. No.: 13/954,508

(22) Filed: Jul. 30, 2013

(65) Prior Publication Data

US 2015/0033595 A1 Feb. 5, 2015

(51) Int. Cl.
*E02F 9/28* (2006.01)

(52) U.S. Cl.
CPC ..... *E02F 9/2833* (2013.01); *E02F 9/2841* (2013.01)

(58) Field of Classification Search
CPC ..... E02F 9/28; E02F 9/2825; E02F 9/2833; E02F 9/2841; E02F 9/2858; E02F 9/2875; E02F 9/2883; E02F 9/2866; E02F 9/2891
USPC ..... 37/446, 449–459; 403/150, 153, 297, 403/355, 374.3, 379.1, 379.2, 322.2, 328; 172/701.1–701.3, 753, 751, 772; 299/107, 109, 111, 113; 285/205
See application file for complete search history.

(56) References Cited

U.S. PATENT DOCUMENTS

| | | | | |
|---|---|---|---|---|
| 4,327,947 | A * | 5/1982 | Bower, Jr. | 299/107 |
| 5,429,396 | A * | 7/1995 | Guest | 285/205 |
| 6,959,506 | B2 * | 11/2005 | Adamic et al. | 37/456 |
| 7,178,274 | B2 * | 2/2007 | Emrich | 37/453 |
| 7,640,684 | B2 * | 1/2010 | Adamic et al. | 37/456 |
| 7,640,685 | B2 * | 1/2010 | Emrich | 37/457 |
| 7,762,015 | B2 * | 7/2010 | Smith et al. | 37/455 |
| 8,122,622 | B2 * | 2/2012 | Smith et al. | 37/455 |
| 8,122,623 | B1 * | 2/2012 | Hughes | 37/457 |

OTHER PUBLICATIONS

Copy of U.S. Appl. No. 13/838,586, filed Mar. 15, 2013.
Copy of U.S. Appl. No. 61/829,769, filed May 31, 2013.

* cited by examiner

*Primary Examiner* — Robert Pezzuto
(74) *Attorney, Agent, or Firm* — Finnegan, Henderson, Farabow, Garrett & Dunner, LLP

(57) ABSTRACT

Various exemplary embodiments of a retainer system for a ground engaging tool. In one exemplary embodiment, the retainer system may include a lock configured to receive a portion of a support member to be locked with the ground engaging tool and a retainer bushing including an inner surface configured to rotatably receive the lock. The lock may be rotatable relative to the inner surface of the retainer bushing between an unlocked position and a locked position. The retainer system may also include a plug configured to substantially fill at least a space between the lock and the inner surface of the retainer bushing when the lock is in the locked position.

20 Claims, 6 Drawing Sheets

RETAINER SYSTEMS FOR GROUND ENGAGING TOOLS

TECHNICAL FIELD

The present disclosure relates generally to ground engaging tools and, more particularly, to retainer systems for removably attaching the ground engaging tools to various earth-working machines.

BACKGROUND

Earth-working machines, such as, for example, excavators, wheel loaders, hydraulic mining shovels, cable shovels, bucket wheels, bulldozers, and draglines, are generally used for digging or ripping into the earth or rock and/or moving loosened work material from one place to another at a worksite. These earth-working machines include various earth-working implements, such as a bucket or a blade, for excavating or moving the work material. These implements can be subjected to extreme wear from the abrasion and impacts experienced during the earth-working applications.

To protect these implements against wear, and thereby prolong the useful life of the implements, various ground engaging tools, such as teeth, edge protectors, and other wear members, can be provided to the earth-working implements in the areas where the most damaging abrasions and impacts occur. These ground engaging tools are removably attached to the implements using customized retainer systems, so that worn or damaged ground engaging tools can be readily removed and replaced with new ground engaging tools.

Many retainer systems have been proposed and used for removably attaching various ground engaging tools to earth-working implements. One example of such retainer systems is disclosed in U.S. Pat. No. 7,762,015 to Smith et al. The disclosed retainer system includes a rotating lock having a slot for receiving a post of an adapter mounted to or part of a work tool. When the lock is rotated, the entrance to the slot is blocked and the post cannot slide out of the slot.

Many problems and/or disadvantages may still exist with these known retainer systems. Various embodiments of the present disclosure may solve one or more of the problems and/or disadvantages.

SUMMARY

According to one exemplary aspect, the present disclosure is directed to a retainer system for a ground engaging tool. The retainer system may comprise a lock configured to receive a portion of a support member to be locked with the ground engaging tool and a retainer bushing including an inner surface configured to rotatably receive the lock. The lock may be rotatable relative to the inner surface of the retainer bushing between an unlocked position and a locked position. The retainer system may also include a plug configured to substantially fill at least a space between the lock and the inner surface of the retainer bushing when the lock is in the locked position.

In another exemplary aspect, the present disclosure is directed to a lock for a ground engaging tool. The lock may comprise a skirt portion extending partway about a retainer axis between a first circumferential end and a second circumferential end. The skirt portion may comprise a base extending in a plane substantially perpendicular to the retainer axis, and a top surface disposed opposite the base. The base and the top surface may not be parallel to one another.

In still another exemplary aspect, the present disclosure is directed to a lock for a ground engaging tool. The lock may comprise a head portion including a tool interface for applying torque to rotate the lock and a skirt portion extending from the head portion and extending circumferentially partway about a retainer axis between a first circumferential end and a second circumferential end. A height of the skirt portion may decrease from the first circumferential end to the second circumferential end.

DETAILED DESCRIPTION

Figure 1:
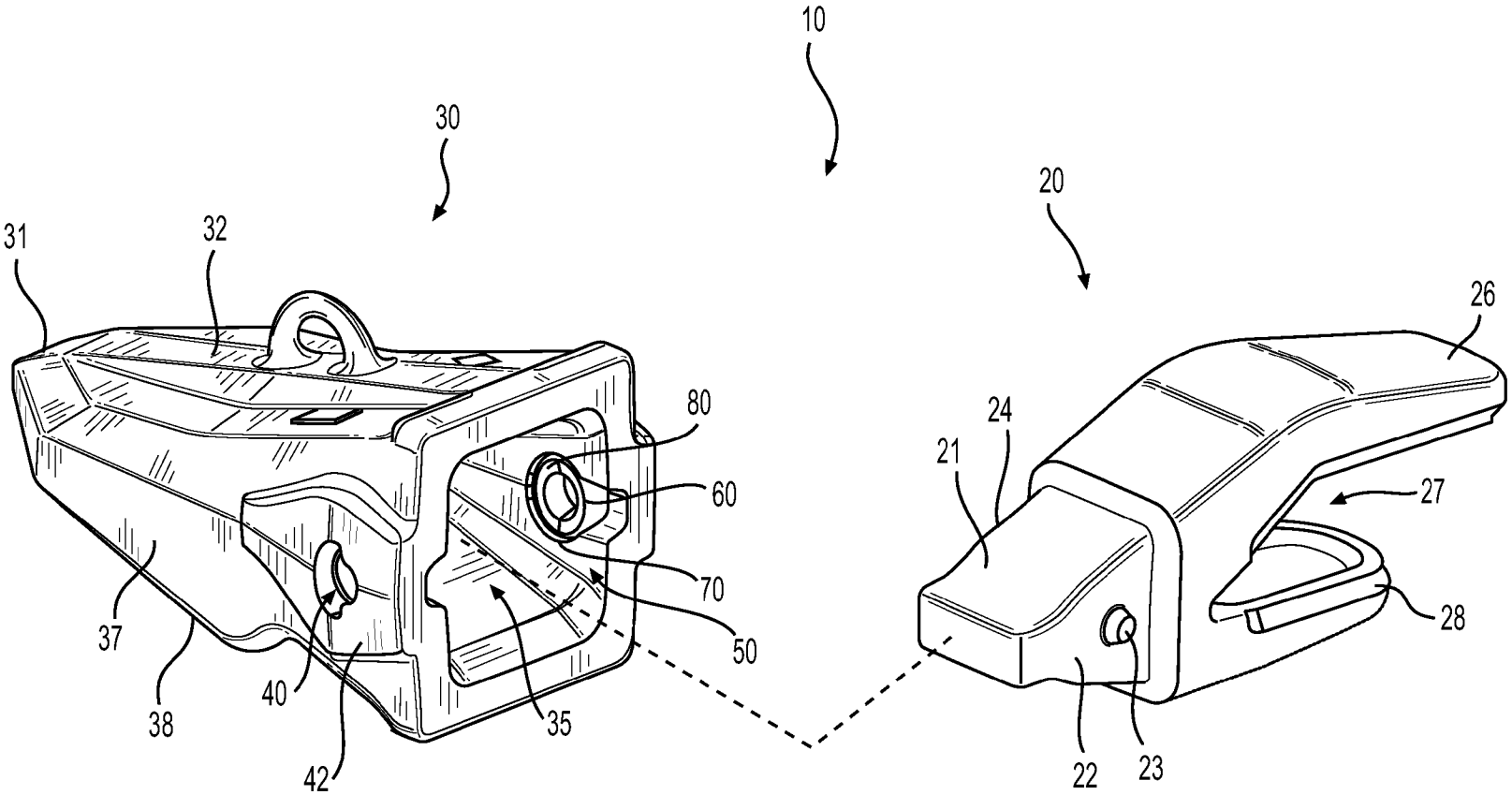
FIG. 1 is a perspective view of a tip of a tooth assembly with a retainer system in place, according to one exemplary embodiment of the present disclosure.

FIG. 1 illustrates a tooth assembly 10 as an exemplary ground engaging tool that may be attached to an earth-working machine employing one or more retainer systems according to the present disclosure. While various embodiments of the present disclosure will be described in connection with a particular ground engaging tool (e.g., tooth assembly 10), it should be understood that the present disclosure may be applied to, or used in connection with, any other type of ground engaging tools or components. Further, it should be understood that one or more features described in connection with one embodiment can be implemented in any of the other disclosed embodiments unless otherwise specifically noted.

As shown in FIG. 1, tooth assembly 10 may include an adapter 20 configured to engage a support structure of an implement (e.g., a base edge of a bucket) associated with an earth-working machine. Tooth assembly 10 may also include a ground-engaging tip 30 configured to be removably attached to adapter 20. Tooth assembly 10 may further include a retainer system 50 configured to secure tip 30 to adapter 20. Tip 30 endures the majority of the impact and abrasion caused by engagement with work material, and wears down more quickly and breaks more frequently than adapter 20. Consequently, multiple tips 30 may be attached to adapter 20, worn down, and replaced before adapter 20 itself needs to be replaced. As will be detailed herein, various exemplary embodiments of retainer system 50, consistent with the present disclosure, may facilitate attachment and detachment of ground engaging tools to and from a support structure of an implement.

Adapter 20 may include a pair of first and second mounting legs 26, 28 defining a recess 27 therebetween for receiving a support structure of an implement. Adapter 20 may be secured in place on the support structure by attaching first mounting leg 26 and second mounting leg 28 to the support structure using any suitable connection method. For example, mounting legs 26 and 28 and the support structure may have corresponding apertures (not shown) through which any suitable fasteners such as bolts or rivets may be inserted to hold adapter 20 in place. Alternatively or additionally, mounting legs 26 and 28 may be welded to the corresponding top and bottom surfaces of the support structure. Any other connection method and/or configuration known in the art may be used alternatively or additionally. For example, in some exemplary embodiments, an adapter may be configured to use the retainer system of the present disclosure to secure the adapter to a suitable support structure of an implement.

Adapter 20 may include a nose 21 extending in a forward direction. As shown in FIG. 1, nose 21 may be configured to be received in a mounting cavity 35 of tip 30. Nose 21 may be configured to support tip 30 during use of the associated implement and to facilitate retention of tip 30 on nose 21 while bearing the load of the work material. Nose 21 may include an integral post 23 extending from each lateral side 22, 24 to cooperate with retainer system 50 to secure tip 30 to adapter 20.

In some alternative embodiments, instead of integral post 23, a removable pin (not shown) may be used to cooperate with retainer system 50. For example, nose 21 may form a through-hole into which the pin may be inserted. The pin, once inserted in the through-hole, may have at least one end portion extending beyond lateral side 22 or 24 to cooperatively engage retainer system 50. For description purposes, the term "post," as used herein, refers to both integral post 23 shown in FIG. 1 and the end portion of the pin extending beyond lateral side 22 or 24. The term "post," as used herein, may also refer to any other structure known in the art that is configured to cooperatively engage with retainer system 50. Post 23 may have various shapes and sizes. In one exemplary embodiment, as shown in FIG. 1, post 23 may have a frustoconical shape.

Mounting cavity 35 inside tip 30 may have a complementary configuration relative to nose 21 of adapter 20. Tip 30 may have various outer shapes. For example, as shown in FIG. 1, tip 30 may generally taper as it extends forward. For example, an upper surface 32 of tip 30 may slope downward as it extends forward, and a lower surface 38 of tip 30 may extend generally upward as it extends forward. Alternatively, lower surface 38 may extend generally straight or downward as it extends forward. At its forward end, tip 30 may have a wedge-shaped edge 31.

Figure 3:
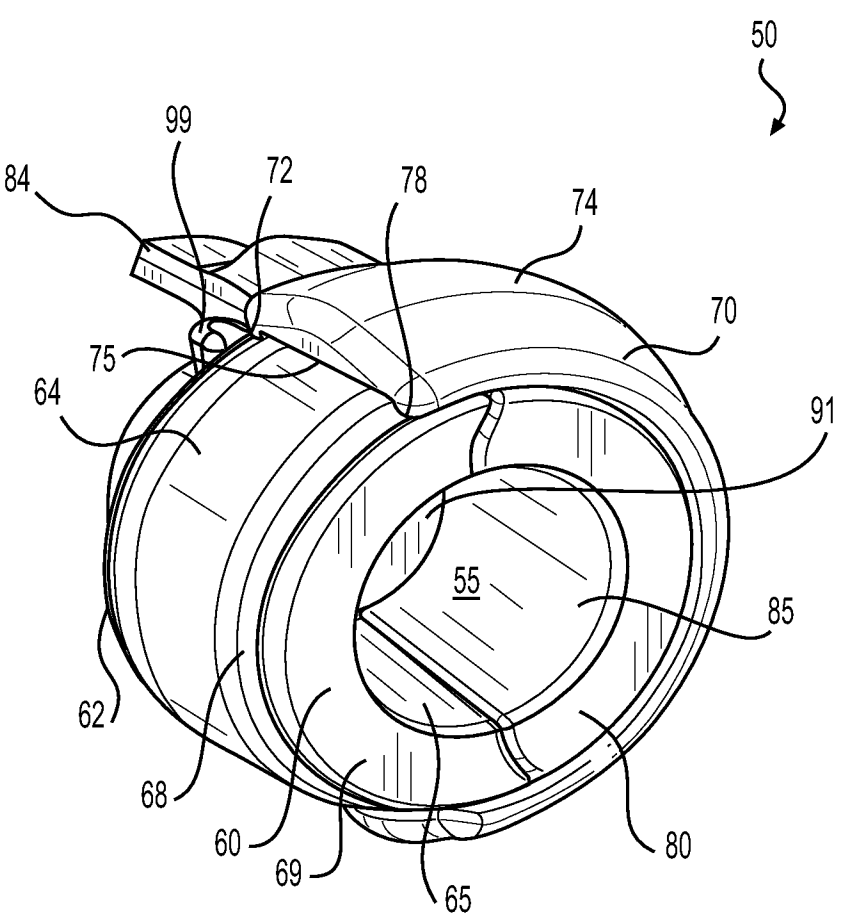
FIG. 3 is a perspective view from a bottom side of the retainer system shown in FIG. 2.
Figure 2:
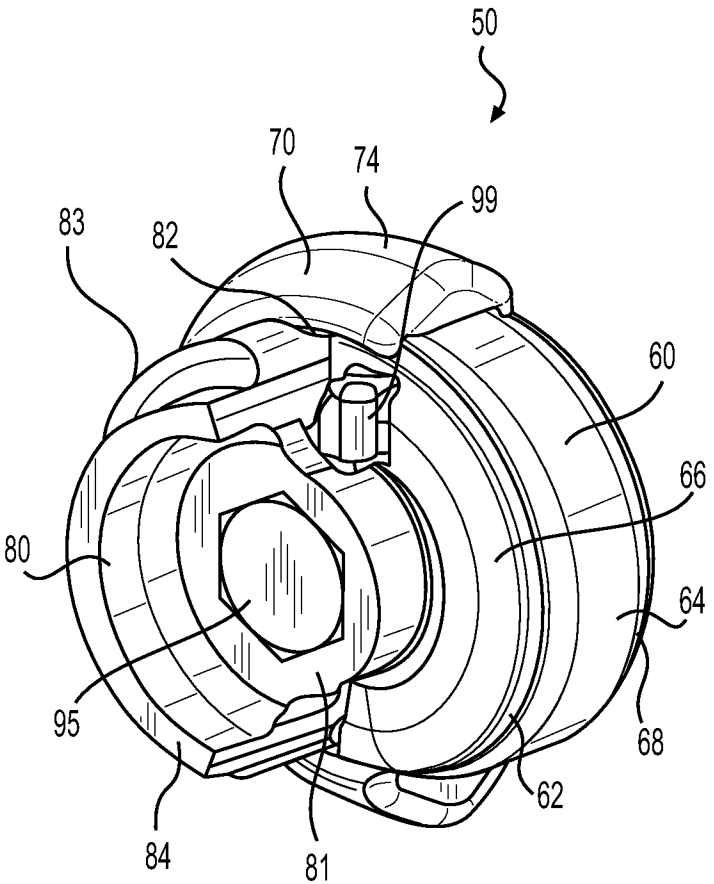
FIG. 2 is a perspective view of a retainer system in a locked position, illustrating various components of the retainer system, according to one exemplary embodiment.

As mentioned above, tip 30 may be secured to adapter 20 via retainer system 50. FIGS. 2 and 3 illustrate assembled retainer system 50 in a locked position, according to one exemplary embodiment. Retainer system 50 may include a lock 60 and a retainer bushing 70, which are configured to rotatably engage with one another to allow movement of lock 60 relative to retainer bushing 70 between an unlocked position and a locked position. Retainer system 50 may also include a plug 80 configured to be inserted into and fill an empty space between lock 60 and retainer bushing 70 when lock 60 is placed in the locked position, so as to substantially prevent work material around retainer system 50 from entering into the space. As will be described in more detail herein, preventing work material from entering the space or substantially reducing the amount of the work material may eliminate or reduce potentially adverse effects (e.g., increased friction between lock 60 and retainer bushing 70 and/or between lock 60 and lock cavity 40) caused by work material packed inside gaps between various components of retainer system 50.

Tip 30 may have various configurations for accommodating lock 60 and retainer bushing 70 therein. For example, in the exemplary embodiment shown in FIG. 1, tip 30 may include a lock cavity 40 formed inside mounting cavity 35 for housing lock 60 and retainer bushing 70. Tip 30 may also include a lock bulge 42 or a thickened wall portion within which lock cavity 40 may be formed. While the exemplary embodiment shown in FIG. 1 has lock cavity 40 and lock bulge 42 on each lateral side 37 of tip 30, tip 30 may have different numbers and/or arrangements of lock cavities 40 and lock bulges 42.

Figure 4:
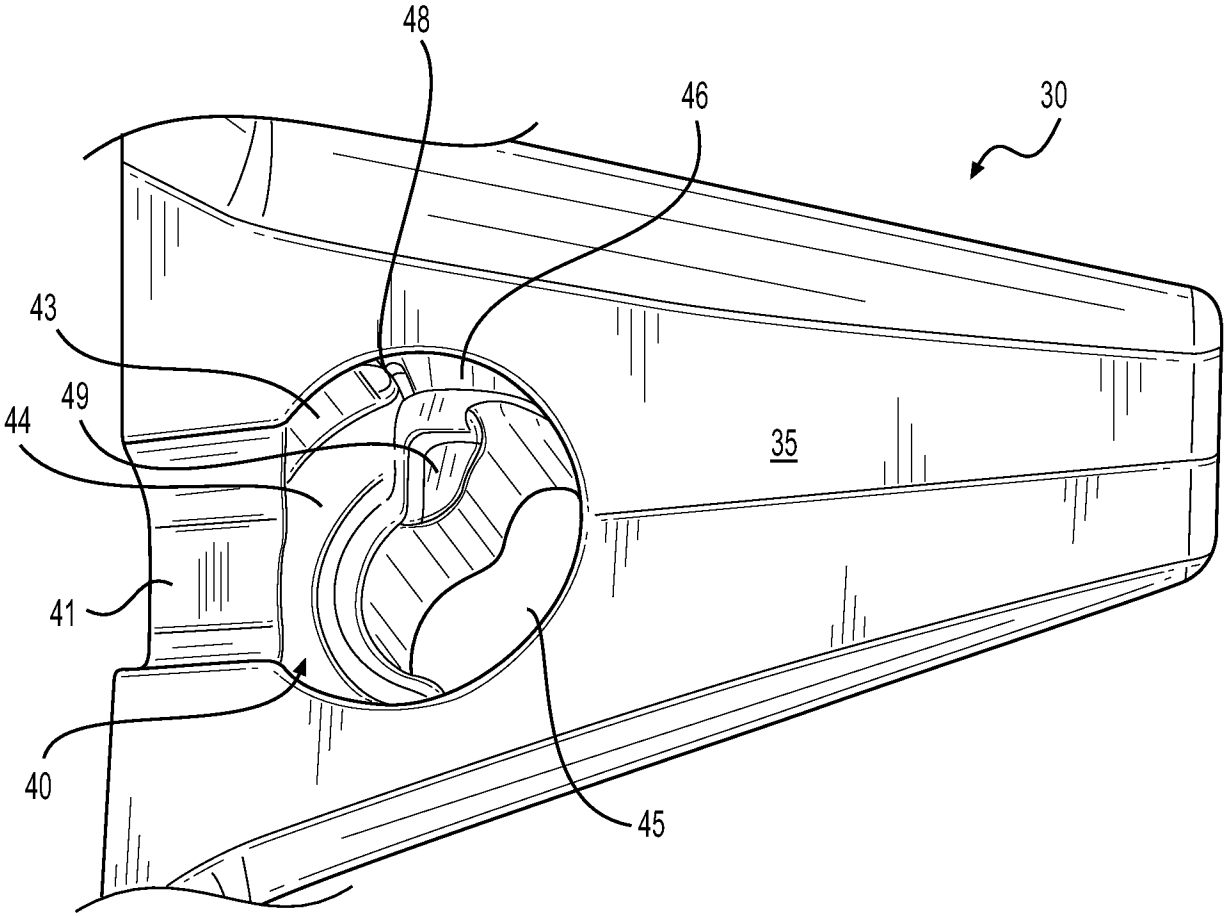
FIG. 4 is a partial view of a mounting cavity inside the tip shown in FIG. 1, illustrating a lock cavity configured to receive the lock assembly shown in FIGS. 2 and 3, according to one exemplary embodiment of the present disclosure.

FIG. 4 illustrates a configuration of lock cavity 40 according to one exemplary embodiment of the present disclosure. Lock cavity 40 may be configured such that lock 60 and retainer bushing 70 may be received within lock cavity 40 in a manner allowing lock 60 to rotate relative to retainer bushing 70. Tip 30 may include an access opening 45 extending from lateral side 37 to lock cavity 40. As will be described in more detail herein, access opening 45 may permit access to at least a portion of retainer system 50 from outside to rotate lock 60 between the locked and unlocked positions and/or to insert and remove plug 80.

As shown in FIG. 4, lock cavity 40 may include a circumferential recess 46 for receiving retainer bushing 70. Circumferential recess 46 may have a shape substantially conforming to an outer surface 74 of retainer bushing 70, such that circumferential recess 46 may closely contact outer surface 74 of retainer bushing 70 when retainer bushing 70 is seated therein. Lock cavity 40 may also include shoulders 48 extending adjacent the two outer ends of circumferential recess 46. Shoulders 48 may be configured to abut circumferential ends 71, 79 of retainer bushing 70 to prevent the rotation of retainer bushing 70 in circumferential recess 46.

Lock cavity 40 may also include a lock recess having a first lock surface 43 and a second lock surface 44 for contacting a side surface 64 and a top surface 66, respectively, of lock 60 when lock 60 is in the locked position. Near one circumferential end of the lock recess, lock cavity 40 may further include a stopper recess 49 for receiving a stopper 99 protruding from top surface 66 of lock 60. Stopper recess 49 may have a shape substantially conforming to an outer surface of stopper 99 that contacts stopper recess 49. As will be described in more detail later with reference to FIGS. 5-8, lock 60 may rotate approximately 180 degrees between the unlocked position and the locked position, and stopper recess 49 may function as a stop member for preventing lock 60 from rotating more than approximately 180 degrees when lock 60 is rotated from the unlocked position (e.g., 0-degree position) to the locked position (e.g., 180-degree position). Lock cavity 40 may also include another suitable stop member, which may or may not be identical to stopper recess 49, near the other circumferential end of the lock recess to prevent lock 60 from rotating more than approximately 180 degrees when lock 60 is rotated from the locked position (e.g., 180-degree position) to the unlocked position (e.g., 0-degree position).

On the rear side of lock cavity 40, tip 30 may open into a side slot 41 that extends rearward from lock cavity 40 along a longitudinal axis of tip 30. Side slot 41 may have a cross-section that allows passage of post 23 of adapter 20 in and out of lock cavity 40.

Figure 6:
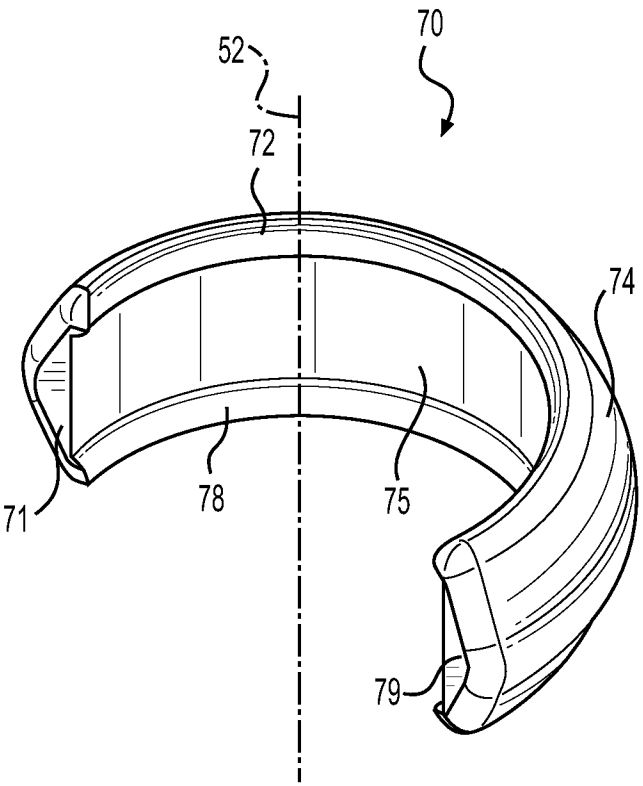
FIG. 6 is a perspective view of a retainer bushing in the retainer system of FIGS. 2 and 3, according to one exemplary embodiment of the present disclosure.
Figure 5:
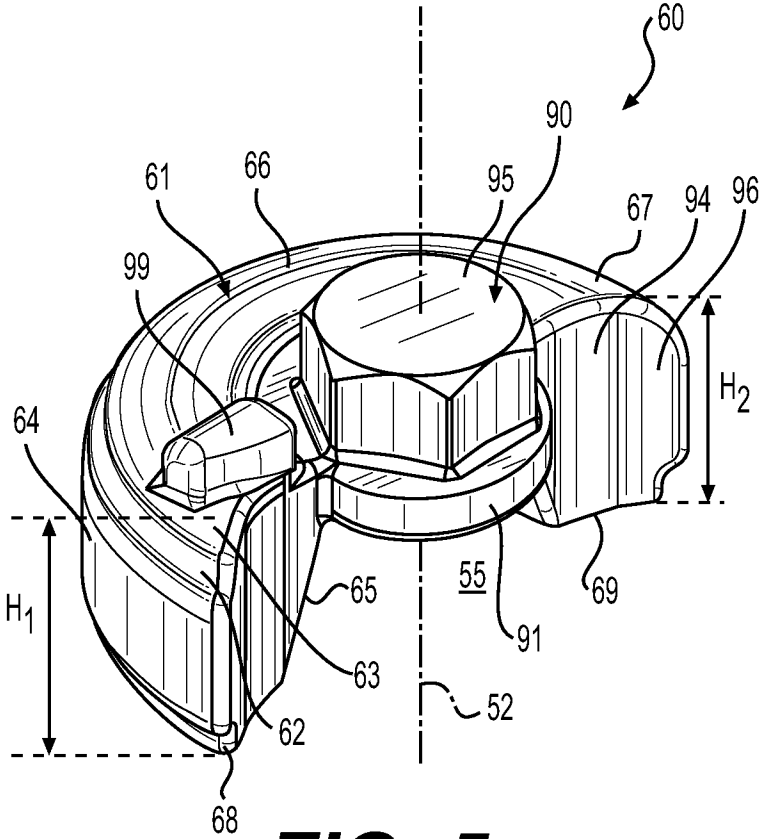
FIG. 5 is a perspective view of a lock in the retainer system of FIGS. 2 and 3, according to one exemplary embodiment of the present disclosure.
Figure 8:
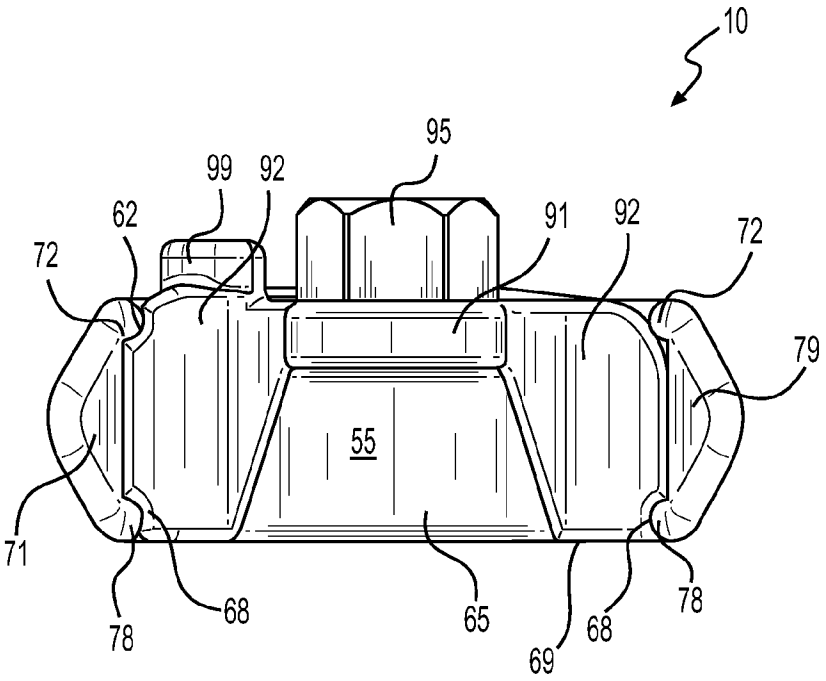
FIG. 8 is a side view of FIG. 7.
Figure 7:
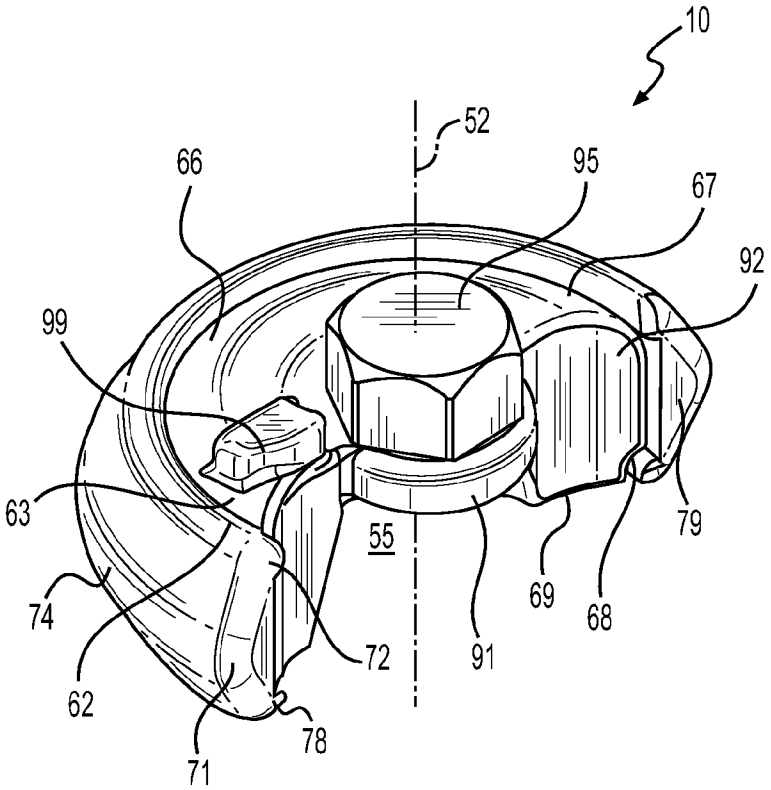
FIG. 7 is a perspective view illustrating a cooperative arrangement between the lock of FIG. 5 and the retainer bushing of FIG. 6.

FIGS. 5 and 6 illustrate lock 60 and retainer bushing 70, respectively, according to one exemplary embodiment of the present disclosure. FIGS. 7 and 8 illustrate assembled lock 60 and retainer bushing 70 in the unlocked position. As shown in the figures, lock 60 and retainer bushing 70 may be configured to rotatably engage with one another, so that lock 60 may rotate relative to retainer bushing 70 between the unlocked position and the locked position. Retainer bushing 70 may be formed of a generally C-shaped body that extends partway around a retainer axis 52 with its outer surface 74 being configured to engage with circumferential recess 46 of lock cavity 40. In some exemplary embodiments, retainer bushing 70 may be symmetrical with respect to a plane that includes retainer axis 52 and bisects retainer bushing 70 in the middle.

Retainer bushing 70 may include an inner surface 75, opposite to outer surface 74, configured to rotatably receive lock 60. To facilitate holding of lock 60 therein, retainer bushing 70 may include a pair of upper and lower annular ridges 72, 78 extending from the top and bottom edges, respectively, of inner surface 75. The pair of upper and lower annular ridges 72 and 78 may engage with corresponding upper and lower grooves 62 and 68 formed on lock 60 to embrace the top and bottom edges of lock 60, as best shown in FIGS. 7 and 8. Further, annular ridges 72 and 78 may engage with corresponding upper and lower grooves 82 and 88 of plug 80 (see FIGS. 9 and 10) when lock 60, retainer bushing 70, and plug 80 are assembled in the locked position, as shown in FIGS. 2 and 3.

Lock 60 may include a head portion 90 and a skirt portion 61 extending from head portion 90. Head portion 90 may include a transverse wall 91 extending in a plane substantially perpendicular to retainer axis 52 and a tool interface 95 extending upwardly from transverse wall 91. Tool interface 95 may be used to facilitate rotation of lock 60 about retainer axis 52. Tool interface 95 may include any type of features configured to be engaged by a tool for applying torque to lock 60 about retainer axis 52. For example, as shown in FIG. 5, tool interface 95 may include a hexagonal head configured to engage with a lug wrench or socket wrench for receiving the torque required to rotate lock 60 about retainer axis 52. When lock 60 is seated within lock cavity 40, tool interface 95 may extend at least partially through lock cavity 40 and be accessible from outside through access opening 45.

Like retainer bushing 70, skirt portion 61 may extend partway around retainer axis 52 with its side surface 64 being configured to rotatably engage with inner surface 75 of retainer bushing 70. Side surface 64 may be concentric with and extend circumferentially around retainer axis 52 and may have substantially the same profile as inner surface 75 of retainer bushing 70. As mentioned above, skirt portion 61 may include a pair of upper and lower grooves 62 and 68 configured to rotatably receive corresponding upper and lower annular ridges 72 and 78 of retainer bushing 70. In some exemplary embodiments, grooves 62 and 68 may be formed around the top and bottom edges, respectively, of side surface 64 and may extend substantially parallel to one another.

In some exemplary embodiments, each of circumferential ends 63, 67 of skirt portion 61 may terminate with a front face 92 aligned substantially parallel to retainer axis 52, as shown in, for example, FIG. 5. Each front face 92 may include a flat portion 94 extending in a radial direction from retainer axis 52 and a curved portion 96 extending from flat portion 94. In one exemplary embodiment, front faces 92 of two circumferential ends 63 and 67 are spaced approximately 180 degrees apart from one another when measured between their flat portions 94. As shown in FIGS. 2 and 3, front faces 92 of two circumferential ends 63 and 67 may be configured to contact corresponding circumferential ends 87, 89 of plug 80 when plug 80 is inserted into the space between lock 60 and retainer bushing 70 in the locked position. Front faces 92 may have substantially the same profile as circumferential ends 87 and 89 of plug 80, so as to substantially eliminate any gap between front faces 92 and circumferential ends 87 and 89.

Skirt portion 61 of lock 60 may include a top surface 66 configured to mate with lock surface 44 of lock cavity 40 (see FIG. 4) when lock 60 is seated in lock cavity 40 and rotated to the locked position. As mentioned above, top surface 66 may have a shape substantially conforming to that of lock surface 44 when lock 60 is in the locked position. In some exemplary embodiments, the height of skirt portion 61, as measured from top surface 66 to a base 69, may vary at least partially between first circumferential end 63 and second circumferential end 67. For example, as shown in FIG. 5, the height of skirt portion 61 may gradually decrease from a first height $H_1$ in first circumferential end 63 to a second height $H_2$ in second circumferential end 67, thereby forming sloped (e.g., helical) top surface 66, which is non-parallel to base 69 that extends in a plane substantially perpendicular to retainer axis 52.

With sloped top surface 66, a space may be created between top surface 66 and lock surface 44 when lock 60 is rotated from the locked position to the unlocked position. During operation of a ground engaging tool that employs retainer system 50 of the present disclosure, work material may enter into and fill up a gap between top surface 66 and lock surface 44 and become packed in the gap over time. The packed work material in the gap may increase friction between top surface 66 and lock surface 44, which may increase torque necessary to rotate lock 60. The space created by sloped top surface 66 may cause the packed work material to break up, loosen, or disintegrate, making it easier for lock 60 to rotate.

In some exemplary embodiments, due to the height variation of skirt portion 61, upper groove 62 may not extend the entire circumference of side surface 64. For example, as best shown in FIGS. 7 and 8, upper groove 62 may thin out as it extends from first circumferential end 63 towards second circumferential end 67 and completely diminish from side surface 64 prior to extending all the way to second circumferential end 67. This partially diminished upper groove 62, however, does not affect the operation of lock 60 and retainer bushing 70 at least partially due to the presence of annular ridges 72 and 78 in retainer bushing 70 that adequately embrace the top and bottom edges of side surface 64.

Lock 60 may be configured to receive at least part of post 23 of adapter 20. For example, as best shown in FIGS. 3, 5, and 7, skirt portion 61 may define a lock slot 55 for receiving post 23. Lock slot 55 may have an open end between two circumferential ends 63 and 67 of skirt portion 61 and a closed end adjacent a middle portion of skirt portion 61. When lock 60 is in the unlocked position shown in FIG. 7, the open end of lock slot 55 may face rearward to allow sliding insertion and removal of post 23 into and out of lock slot 55. In some embodiments, lock slot 55 may have a size and shape such that it can receive frustoconical post 23 of adapter 20. For example, base 69 of lock 60 may have a sloped surface 65 extending from transverse wall 91 at an angle corresponding to the slope of frustoconical post 23. As a result, sloped surface 65 may be configured to contact with frustoconical post 23 of adapter 20 when post 23 is received in lock slot 55.

Once post 23 is received in lock slot 55, lock 60 can be rotated about retainer axis 52 to the locked position. In this locked position, sloped surface 65 of lock slot 55 in close contact with post 23 may preclude sliding movement of post 23 relative to lock slot 55, thereby preventing sliding movement of tip 30 relative to adapter 20. After lock 60 is rotated to the locked position, plug 80 may be inserted into the space between lock 60 and retainer bushing 70. Plug 80 may be configured such that, when plug 80 is inserted, plug 80 can close the open end of lock slot 55 with a sloped surface 85 extending from a base of plug 80, as best shown in FIG. 3. Sloped surface 65 of lock 60 and sloped surface 85 of plug 80 may cooperate with one another to define an interior of lock slot 55 that may conform to the shape and size of post 23.

As briefly described above, when lock 60 is placed in a locked position, plug 80 may be inserted into and fill in a space between lock 60 and retainer bushing 70 to substantially prevent work material around retainer system 50 from entering into the space, thereby substantially reducing the packing of work material in retainer system 50 and making it easier to rotate lock 50 relative to retainer bushing 70 (e.g., from the locked position to an unlocked position). Plug 80 may have a variety of shapes and/or sizes, depending on the configurations of lock 60, retainer bushing 70, and/or post 23 with which plug 80 is to be employed. For example, plug 80 may be sufficiently sized and/or shaped to fill the space between lock 60 and retainer bushing 70, and the shape and/or size of plug 80 may be appropriately adjusted to ensure that plug 80 fills substantially all of the space between lock 60 and retainer bushing 70 in the locked position.

Figure 10:
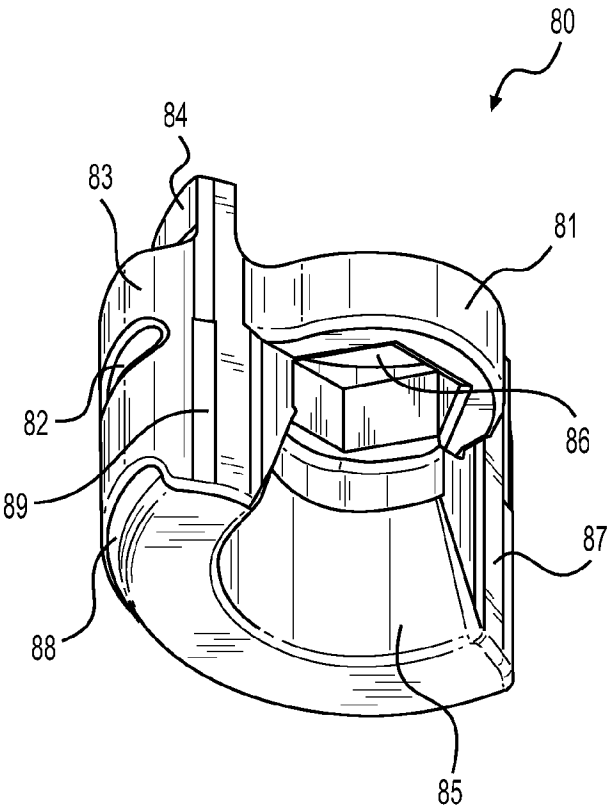
FIG. 10 is a perspective view from a bottom side of the plug shown in FIG. 9.
Figure 9:
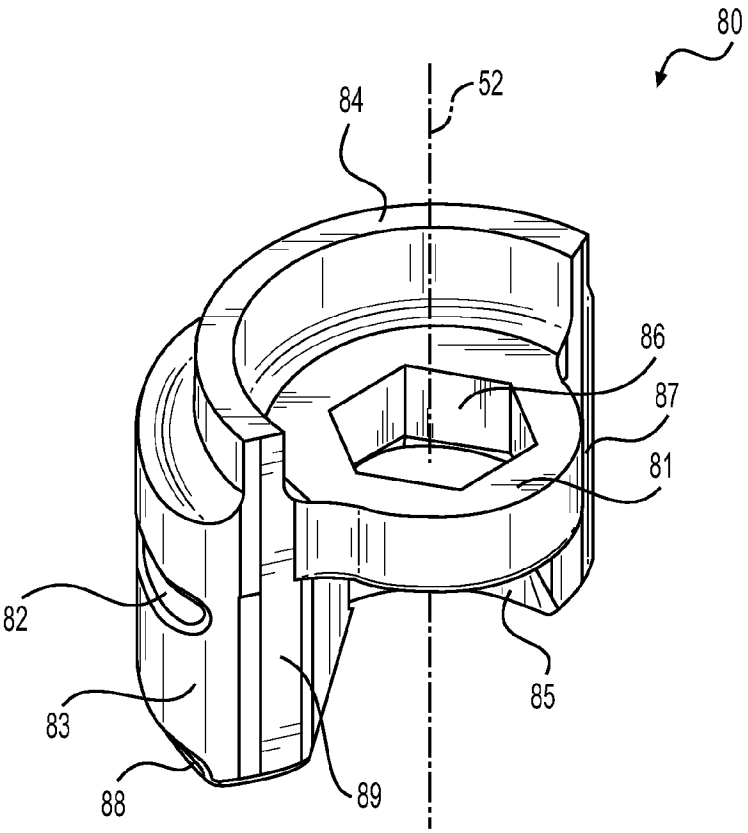
FIG. 9 is a perspective view of a plug in the retainer system of FIGS. 2 and 3, according to one exemplary embodiment of the present disclosure.

Referring to FIGS. 9 and 10, plug 80 may extend partway around retainer axis 52 between first circumferential end 87 and second circumferential end 89. When plug 80 is fitted into the space between lock 60 and retainer bushing 70 in the locked position, first and second circumferential ends 87 and 89 may be configured to closely contact corresponding front faces 92 of lock 60, as shown in FIGS. 2 and 3. Plug 80 may also have an outer surface 83 configured to closely contact inner surface 75 of retainer bushing 70.

In various exemplary embodiments, plug 80 may be force-fitted and force-removed into and out of the space between lock 60 and retainer bushing 70. Accordingly, plug 80 may be formed of a flexible material, such as rubber or any other suitable polymer material that permits a certain degree of deformation for insertion and removal of plug 80. To facilitate the insertion and/or removal of plug 80, plug 80 may be provided with a ridge 84 extending from its top surface, where plug 80 can be removed by pulling on ridge 84 along the top surface.

Plug 80 may include an appropriate provision for securely holding plug 80 in place. For example, as shown in FIGS. 9 and 10, plug 80 may include a pair of upper and lower grooves 82 and 88 configured to mate with corresponding upper and lower annular projections 72 and 78, respectively, of retainer bushing 70. Alternatively or additionally, plug 80 may include a feature that may hold or otherwise structurally associate with tool interface 95 of lock 60. For example, as shown in FIGS. 9 and 10, plug 80 may include a ring 81 with a hexagonal opening 86 for receiving a hexagonal head of tool interface 95. Hexagonal opening 86 may have the same (or a slightly smaller size) as the size of the hexagonal head of tool interface 95, so as to allow interference-fit between hexagonal opening 86 and the hexagonal head.

The above-disclosed provisions for securing plug 80 to lock 60 and/or retainer bushing 70 are exemplary only. Any other suitable securing structure or mechanism known in the general mechanical art can be used additionally or alternatively.

Ground engaging tools and the associated retainer systems of the present disclosure are not limited to the exemplary configurations described above. For example, a ground engaging tool may employ a different number and configuration of posts 23, locks 60, retainer bushings 70, and/or plug 80. Further, certain exemplary aspects of the present disclosure may provide various alternative and/or additional configurations of retainer systems for removably attaching ground engaging tools to suitable support structure of an implement.

Industrial Applicability

The disclosed retainer systems and ground engaging tools may be applicable to various earth-working machines, such as, for example, excavators, wheel loaders, hydraulic mining shovels, cable shovels, bucket wheels, bulldozers, and draglines. When installed, the disclosed retainer systems and ground engaging tools may protect various implements associated with the earth-working machines against wear in the areas where the most damaging abrasions and impacts occur and, thereby, prolong the useful life of the implements.

The disclosed configurations of various retainer systems and components may provide secure and reliable attachment and detachment of ground engaging tools to various earth-working implements. In particular, certain configurations of the disclosed retainer systems may address certain issues associated with work material getting into the space around the retainer system and increasing friction between components of the retainer system and/or between retainer system and a ground engaging tool. Moreover, certain configurations of the disclosed retainer systems may reduce friction between components of a retainer system and/or between a component of a retainer system and a ground engaging tool.

For example, in one exemplary embodiment shown in FIGS. 2 and 3, retainer system 50 may include lock 60, retainer bushing 70, and a plug 80. Retainer bushing 70 is configured to mate with lock cavity 40 of tip 30 (see FIGS. 1 and 4), and lock 60 is configured to rotatably engage with inner surface 75 of retainer bushing 70 so as to rotate between an unlocked position and locked position. To attach tip 30 to adapter 20, lock 60 and retainer bushing 70 are assembled into lock cavity 40 of tip 30 in the unlocked position (see FIGS. 7 and 8) with lock slot 55 of lock 60 opening out to side slot 41 that extends rearward to allow passage of post 23 of adapter 20. Once post 23 is received inside lock slot 55, lock 60 is rotated approximately 180 degrees about retainer axis 52 to the locked position, where sloped surface 65 of lock slot 55 closely contacts post 23 to prevent sliding movement of tip 30 relative to adapter 20. To rotate lock 60 from the unlocked position to the locked position, a suitable tool such as a socket wrench is inserted through access opening 45 of tip 30 to engage with and apply torque to tool interface 95. In the locked position, plug 80 is forced into and fills the space between lock 60 and retainer bushing 70 to prevent work material around retainer system 50 from entering into the space. Further, sloped surface 65 of lock 60 and sloped surface 85 of plug 80 cooperate with one another to define an interior of lock slot 55 that may conform to the shape and size of post 23.

To detach tip 30 from adapter 20, plug 80 is first removed from retainer system 50 by grasping and pulling ridge 84 of plug 80. After plug 80 is removed, a suitable tool is inserted through access opening 45 to engage and apply torque in the counterclockwise direction to rotate lock 60 approximately 180 degrees from the locked position to the unlocked position. In this unlocked position, post 23 is removed from lock slot 55, and adapter 20 is removed from mounting cavity 35 of tip 30.

In some exemplary embodiments shown in FIGS. 5-8, the height of skirt portion 61 when measured from top surface 66 to base 69 gradually decreases from first circumferential end 63 to second circumferential end 67, thereby forming sloped top surface 66. Sloped top surface 66 creates a space between top surface 66 and lock surface 44 when lock 60 is rotated from the locked position to the unlocked position. The space created by sloped top surface 66 may cause packed work material in a gap between top surface 66 and lock surface 44 to break up, loosen, or disintegrate, thereby substantially reducing the torque necessary to rotate lock 60 from the locked position to the unlocked position.

It will be apparent to those skilled in the art that various modifications and variations can be made to the disclosed retainer systems and/or ground engaging tool systems. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A retainer system for a ground engaging tool, comprising:
- a lock configured to receive a portion of a support member to be locked with the ground engaging tool;
- a retainer bushing including an inner surface configured to rotatably receive the lock, wherein the lock is rotatable relative to the inner surface of the retainer bushing between an unlocked position and a locked position; and
- a plug that is separable from the lock and configured to substantially fill at least a space between the lock and the inner surface of the retainer bushing when the lock is in the locked position.

2. The retainer system of claim 1, wherein the lock comprises a skirt portion extending partway about a retainer axis between a first circumferential end and a second circumferential end, wherein a height of the skirt portion decreases from the first circumferential end to the second circumferential end.

3. The retainer system of claim 1, wherein the lock comprises a base and a top surface, wherein the base and the top surface are not parallel to one another.

4. The retainer system of claim 1, wherein the retainer bushing comprises an annular ridge extending from the inner surface.

5. The retainer system of claim 4, wherein the lock comprises a groove extending on a side surface of the lock and being configured to engage the annular ridge.

6. The retainer system of claim 4, wherein the plug comprises a groove extending on a side surface of the plug and being configured to engage the annular ridge in the locked position.

7. The retainer system of claim 1, wherein the retainer bushing comprises a pair of ridges extending from a top edge and a bottom edge of the inner surface, respectively.

8. The retainer system of claim 1, wherein the plug is configured to substantially prevent work material around the lock and the retainer bushing from entering the space in the locked position.

9. The retainer system of claim 1, wherein the lock comprises a tool interface configured to engage a tool for applying torque to the lock, and wherein the plug comprises a ring configured to receive the tool interface.

10. The retainer system of claim 1, wherein the lock and the plug are configured to define a lock recess for securing the portion of the support member when the plug is inserted to fill the space between the lock and the inner surface of the retainer bushing when the lock is in the locked position.

11. The retainer system of claim 1, wherein the lock is configured to rotate approximately 180 degrees relative to the retainer bushing between the unlocked position and the locked position.

12. A lock for a ground engaging tool, comprising:
- a skirt portion extending partway about a retainer axis between a first circumferential end and a second circumferential end, the skirt portion comprising:
  - a base extending in a plane substantially perpendicular to the retainer axis, and
  - a top surface disposed opposite the base,
- wherein the base and the top surface are not parallel to one another and the skirt portion is symmetric about no plane parallel to the retainer axis.

13. The lock of claim 12, wherein a height of the skirt portion decreases from the first circumferential end to the second circumferential end.

14. The lock of claim 12, wherein the skirt portion further comprises a side surface extending between the base and the top surface and configured to be rotatably received in a retainer bushing.

15. The lock of claim 14, further comprising a groove extending about the retainer axis on the side surface of the skirt portion.

16. The lock of claim 12, further comprising a tool interface configured to engage a tool for applying torque to the lock.

17. A lock for a ground engaging tool, comprising:
- a head portion including a tool interface for applying torque to rotate the lock; and
- a skirt portion extending from the head portion and extending circumferentially partway about a retainer axis between a first circumferential end and a second circumferential end,
- wherein a height of the skirt portion is greater at the first circumferential end than at the second circumferential end.

18. The lock of claim 17, wherein the skirt portion further comprises a side surface extending between a base and a top surface and configured to be rotatably received in a retainer bushing.

19. The lock of claim 18, further comprising a groove extending about the retainer axis on the side surface of the skirt portion.

20. The lock of claim 17, further comprising a tool interface configured to engage a tool for applying torque to the lock.

* * * * *